United States Patent [19]

Foley

[11] 4,416,315

[45] Nov. 22, 1983

[54] DEVICE FOR CARRYING VALUABLES

[75] Inventor: Newman C. Foley, Superior, Wis.

[73] Assignee: N.B.F. Company, Inc., Superior, Wis.

[21] Appl. No.: 458,973

[22] Filed: Jan. 18, 1983

[51] Int. Cl.[3] ..... A44B 21/00

[52] U.S. Cl. ..... 150/47; 224/229; 224/230; 224/252

[58] Field of Search ..... 224/229, 226, 230, 240, 224/252, 269; 150/37, 38, 34, 47

[56] References Cited

U.S. PATENT DOCUMENTS

| | | | |
|---|---|---|---|
| 1,213,758 | 1/1917 | Delaney | 150/47 |
| 1,679,606 | 8/1928 | Grayes | 150/47 X |
| 2,126,826 | 8/1938 | Shively | 150/47 X |
| 2,908,306 | 10/1959 | Chorost | 150/47 |

*Primary Examiner*—Steven M. Pollard
*Attorney, Agent, or Firm*—Jacobi, Siegel, Presta, Marzullo & Aronson

[57] ABSTRACT

A device for carrying valuables comprising a closeable container, such as a wallet or purse, having a hanger member, such as a flexible and resilient clip, movably secured thereto. One end of the hanger member is movably secured to a hanger support member that is movably mounted within the container. One end of the container is provided with an aperture through which a portion of the hanger member is moved when it is disposed in an inner or retracted position wherein the hanger member can engage the adjacent portion of a pocket or the like in which the container is placed. The hanger member is movable to an outer or extended position out of the container wherein the hanger member may be positioned over a garment hem and under the belt of the user with the container hanging inside the garment and below the belt. Means are provided on the container and on the support member for releasably maintaining the support member and the hanger member in the inner or retracted position.

7 Claims, 5 Drawing Figures

DEVICE FOR CARRYING VALUABLES

BACKGROUND OF THE INVENTION

The present invention relates to a device for carrying valuables and, more particularly, to such a device which can be removably secured to a pants hem-line or the like while positioned inside the pants or can be removably secured to the adjacent portion of the pocket in a coat or jacket in which it is positioned.

Although many different types of devices for carrying valuables, such as wallets or purses, have been used and have generally served the intended purpose, very few of these have been provided with suitable means for preventing or minimizing accidental loss or theft while being carried by a person in a pants, jacket or coat pocket. The carrying devices having means for preventing or minimizing accidental loss or theft have been subject to one or more of the following disadvantages:

1. They have been bulky and thus difficult to handle and place in a pocket;
2. They have been complicated in construction and thus difficult to manufacture;
3. They have been expensive;
4. They have been unattractive in appearance;
5. Because of the size of the security means, they have had very little room for carrying valuables;
6. They have been uncomfortable to the user while carried in a pants pocket or the like; and/or
7. They have been unreliable in operation and subject to failure.

A need has arisen, therefore, for a simple, reliable and inexpensive device for carrying valuables which prevents or minimizes accidental loss or theft, and which can be carried in a secure manner inside pants or in a coat or jacket pocket. The carrying device of the present invention meets this need and is not subject to any of the aforementioned disadvantages.

SUMMARY OF THE INVENTION

The device for carrying valuables of the present invention comprises a container having means for selectively opening or closing it, such as a zipper or the like, with an aperture through one end of the container. A hanger support member is movably mounted within the container and is movably connected at its outer end to a hanger member, such as a flexible and resilient clip.

The hanger member and support member are movable to a first extended position wherein the support member is disposed adjacent the one container end and the hanger member is disposed outwardly or removed from the container. In this extended position, the hanger member or clip may be positioned over the pants hem-line and under the belt of the user, with the container hanging inside the pants and below the belt line of the user.

The hanger member and support member are movable to a second retracted or inner position wherein the support member is positioned inwardly from the one container end and a portion of the hanger member extends through the container aperture into the container. In this second position, the hanger member or clip can engage the adjacent portion of a pocket of a coat or jacket in which the container is placed.

The hanger member and support member are releasably maintained in the inner position by suitable releasable connecting means on the container and on the support member, such as a snap-type connector on the support member which cooperates with a complementary connector on the inner portion of the container.

It will be readily seen, therefore, that the valuables carrying device of the present invention can be easily secured to the pants of the user while positioned inside the pants or to the adjacent pocket portion while in a coat or jacket pocket, thereby preventing or minimizing accidental loss or theft.

DESCRIPTION OF THE PREFERRED EMBODIMENT

Figure 1:
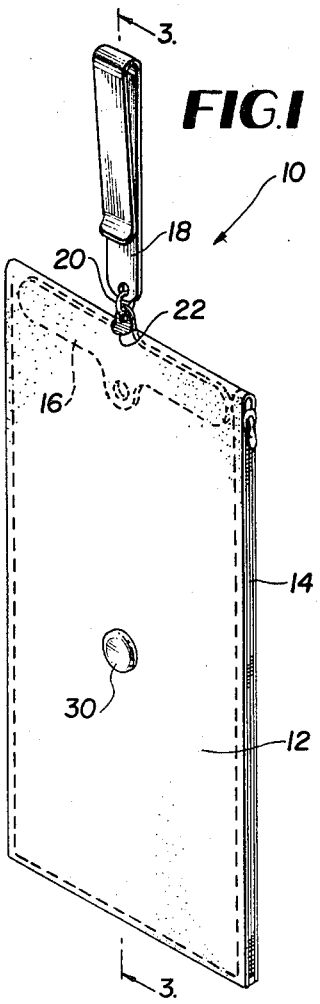
FIG. 1 is a perspective view of the valuable carrying device of the present invention.
Figure 3:
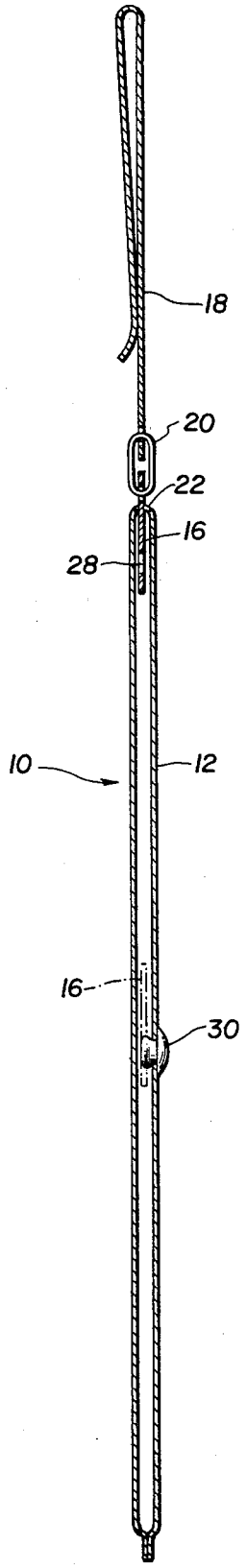
FIG. 3 is an enlarged sectional view taken substantially along line 3—3 in FIG. 1.
Figure 4:
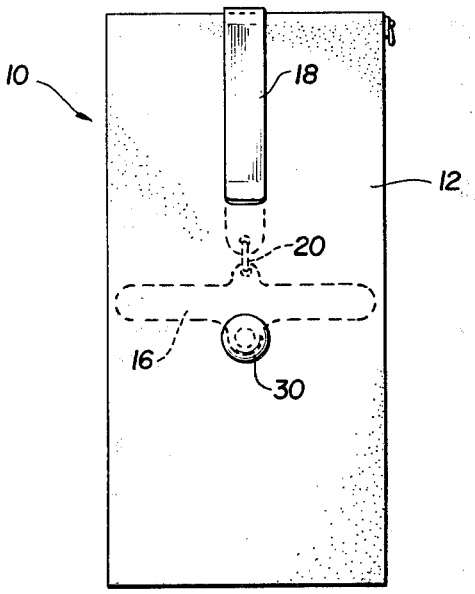
FIG. 4 is a front elevational view of the valuables carrying device of the present invention, showing the hanger member or clip in a retracted or inner position.

As shown in FIGS. 1, 3 and 4, the valuables carrying device 10 of the present invention generally comprises a container 12 of any suitable type and shape having suitable means such as a zipper 14 for selectively opening or closing it, a hanger support member 16 movably or slidably mounted within the container, and a hanger member 18 movably connected to the support member 16 by any suitable means such as a link 20 which enables the hanger member 18 to be pivoted relative to the support member 16.

The support member 16 may be of any suitable construction and, preferably, is of a width sufficient to enable it to be easily slidably moved within the container 12 between the positions shown in broken lines in FIGS. 1 and 4. As shown in FIG. 1, the upper end of the container 12 is provided with an aperture 22 which is large enough to receive therethrough a portion of the hanger member or clip when it is moved to the position shown in FIG. 4.

The hanger member 18 may be of any suitable construction and, preferably, is in the form of a generally U-shaped spring clip member formed of a suitable flexible and resilient material. The hanger member 18 is movable between the outer or extended position shown in FIG. 1, wherein the support member 16 is disposed adjacent the upper container end, and the retracted or inner position shown in FIG. 4 wherein a portion of the hanger member extends through the aperture 22 into the container 12, with the support member being positioned inwardly from the upper container end.

Figure 2:
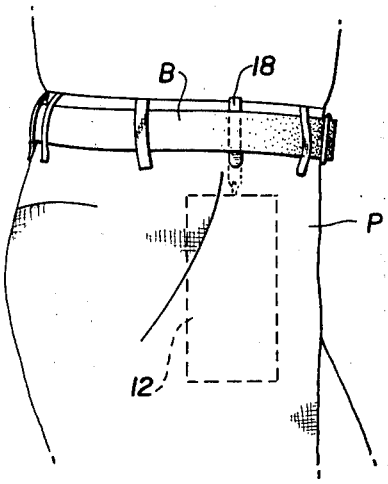
FIG. 2 is a side elevational view showing the valuables carrying device disposed inside the pants and secured to the pants hem-line below the belt of the user.

When the hanger member 18 is in the outer or extended position shown in FIG. 1, the container 12 can be placed inside the pants P of a user and the hanger member can be positioned over the pants hem-line and under the user's belt B, as shown in FIG. 2 of the drawing. In this manner, the hanger member 18 serves to secure the valuables container 12 and to prevent or minimize the accidental loss or theft thereof. The pivotal connection between the hanger member 18 and the support member 16 enables the support member to move within the container 12 as a result of body motion, while the hanger member remains securely in one position on the hem-line, being held in place by the belt of the user.

Figure 5:
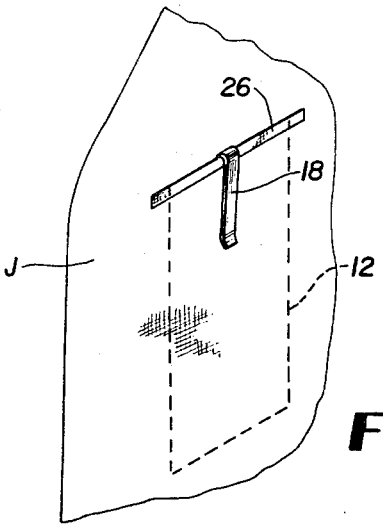
FIG. 5 is a perspective view showing the valuables carrying device disposed in and secured to the pocket of a coat or jacket.

When the hanger member is in the retracted or inner position shown in FIG. 4, the container 12 may be positioned within a pocket 26 of a coat or jacket J with the outer portion of the hanger member engaging the adjacent portion of the pocket, as shown in FIG. 5, for the purpose of securing the container 12 within the pocket and preventing or minimizing accidental loss or theft thereof.

As shown in FIGS. 3 and 4, the support member 16 and the container 12 may be provided with suitable connector means, such as snap-connectors 28 and 30, respectively, for releasably maintaining the support member 16 and the hanger member 18 in the inner or retracted positions shown in FIG. 4.

From the foregoing description, it will be readily seen that the valuables carrying device of the present invention can conveniently be used with pants or with a pocket in a jacket or coat by merely moving the positions of the support member 16 and hanger member 18 relative to the valuables container 12.

What is claimed is:

1. A device for carrying valuables comprising:

a container for the valuables, said container having means for selectively opening or closing it and having an aperture in one end thereof;

a hanger support member movably mounted within said container;

a hanger member movably connected at one end to said support member;

said hanger member and said support member being movable between a first extended position wherein said support member is disposed adjacent said one container end and said hanger member is removed from said container, and a second retracted position wherein said support member is positioned inwardly from said one container end and said one end of said hanger member is disposed within said container with a portion of said hanger member extending through said container aperture; and means on said container and said support member for releasably maintaining said support member and said hanger member in said retracted position.

2. The valuables carrying device of claim 1 wherein said container is of a size adapted to fit beneath the pants of a user below the belt-line, and is provided with closure means on one side thereof for selectively opening or closing it.

3. The valuables carrying device of claim 1 wherein said support member is of a width that is close to the width of said container, said support member being slidably movable within said container.

4. The valuables carrying device of claim 1 wherein said hanger member is pivotally connected to said support member.

5. The valuables carrying device of claim 1 wherein said hanger member is formed of flexible and resilient material.

6. The valuables carrying device of claim 5 wherein said hanger member is a generally U-shaped spring clip.

7. The valuables carrying device of claim 1 wherein said means for releasably maintaining said support member and said hanger member in said retracted position comprise snap-connectors on said container and said support member.

* * * * *